US005280821A

United States Patent [19]

Fischer et al.

[11] Patent Number: 5,280,821

[45] Date of Patent: Jan. 25, 1994

[54] MOLDING APPARATUS INCLUDING VENTS COMPRISING ELONGATED SLOTTED BARS

[75] Inventors: Kurt Fischer; Hans Leutwiler, both of Schaffhausen, Switzerland

[73] Assignee: Georg Fischer AG, Schaffhausen, Switzerland

[21] Appl. No.: 950,788

[22] Filed: Sep. 24, 1992

[30] Foreign Application Priority Data

Sep. 27, 1991 [CH] Switzerland ..... 2869/91

[51] Int. Cl.[5] ..... B22C 7/04; B22C 15/00

[52] U.S. Cl. ..... 164/169; 164/238; 164/239; 164/241; 164/410

[58] Field of Search ..... 164/169, 241, 242, 243, 164/239, 240, 235, 237, 238, 160.1, 160.2, 410

[56] References Cited

FOREIGN PATENT DOCUMENTS 3813755 11/1989 Fed. Rep. of Germany ..... 164/238

*Primary Examiner*—J. Reed Batten, Jr.

*Attorney, Agent, or Firm*—Bachman & LaPointe

[57] ABSTRACT

The molding apparatus includes a pattern plate carrier for air-pressurized compaction processes. The carrier is equipped with air venting structure running along the inner contour of the mold box of the sand molding apparatus in the form of elongated slotted bars.

19 Claims, 2 Drawing Sheets

MOLDING APPARATUS INCLUDING VENTS COMPRISING ELONGATED SLOTTED BARS

BACKGROUND OF THE INVENTION

The present invention relates to a pattern plate carrier for air-pressurized compaction processes and, more particularly, a carrier for supporting a pattern plate in a sand mold making process wherein the carrier is equipped with air venting structure running along the inner contour of the molding box of the sand molding apparatus.

In modern sand molding processes used to produce sand molds for casting molten metal, compressed air is made to flow vertically from the top of the sand located in the sand mold to the bottom. In order to obtain better compaction of the sand on the pattern in the molding apparatus, particularly in the marginal zones along the interior wall of the molding box, the compressed air flowing in on the upper side of the molding box and vertically down through the molding sand must be able to escape on the pattern side of the molding box. Heretofore, this has been accomplished by providing orifices in the pattern plate in the form of round nozzles in the area of the pattern plate between the pattern and the molding box, see for example German Patentschrift 26 08 740. As a result of the foregoing, the area of the pattern plate which can be utilized is greatly reduced.

Naturally, it would be highly desirable to provide a sand molding apparatus which would allow for the air flowing through the sand material to escape on the pattern side of the mold while at the same time allowing for high utilization of the area of the pattern plate thereby resulting in higher casting yield per mold box.

Accordingly, it is the principal object of the present invention to provide an apparatus as aforesaid which allows for an enlarging of the pattern plate area utilized in a molding box thereby resulting in higher casting yield per molding box.

It is a further object of the present invention to provide a pattern plate carrier with venting structure for allowing air to escape the molding space on the pattern side of the molding box.

It is a particular object of the present invention to provide a pattern plate carrier as aforesaid which includes elongated slotted bars around the periphery of the pattern plate for venting air.

It is a still further object of the present invention to provide a pattern plate carrier which is simple in structure and efficient in operation.

Further objects and advantages of the present invention will appear hereinbelow.

SUMMARY OF THE INVENTION

In accordance with the present invention the foregoing objects and advantages are readily obtained.

The present invention relates to an apparatus for compacting molding sand with compressed air. The apparatus includes a pattern plate having a molding box positioned thereon for defining therewith a molding space. In one embodiment of the present invention vents are provided on the pattern plate for allowing the compressed air to escape the molding space on the pattern side of the molding box, the vents being in the form of a plurality of elongated slotted bars each having a longitudinal axis and a plurality of slots extending substantially transversely to the longitudinal axis of the bars. By providing slotted bars as aforesaid, the space requirement for the venting structure is considerably reduced when compared to the nozzle structure of the prior art. Consequently, the utilization of the pattern plate can be increased over the prior art molding structures. The enlarged utilization area of the pattern plate permits better coverage with the patterns which, consequently, results in a higher casting yield per mold box.

In accordance with the preferred embodiment of the present invention a pattern plate carrier for supporting a pattern plate in a sand mold making process is equipped with an air venting structure running along the inner contour of the molding box of the sand molding apparatus. The pattern plate carrier comprises a carrier surface for supporting a pattern plate thereon. A molding box surrounds the pattern plate and is spaced therefrom so as to define between the molding box and the pattern plate a peripheral area on the surface of the carrier. In accordance with a particular feature of the present invention, the peripheral area on the surface of the carrier is provided with an air venting structure extending around the pattern plate. In the preferred embodiment the air venting structure comprises a plurality of elongated slotted bars each of which has a longitudinal axis and a plurality of slots in the elongated bars extending substantially transversely to the longitudinal axis of the bars. By providing slotted bars as aforesaid, the amount of machining required in the pattern plate carrier to effect air evacuation is reduced when compared to a nozzle structure which requires a plurality of precisely located bores. As a result, the structure of the present invention is efficient and economical.

In accordance with a further feature of the present invention, the peripheral area surface on the carrier is provided with a recessed groove for receiving the elongated slotted bars. The slotted bars form with the bottom surface of the groove a venting channel for the compressed air which allows the air to flow on the pattern side out of the molding box.

A further feature of the present invention provides the slotted bars with slots having a width of, preferably, less than or equal to 0.30 mm with the width of the slot increasing with the slot depth where the maximum slot width is, as stated above, less than or equal to 0.30 mm.

BRIEF DESCRIPTION OF THE DRAWINGS

The present invention is explained in greater detail hereinbelow with reference to the following drawings wherein:

FIGS. 1A and 1B are top views of carrier plates used in the making of sand molds wherein FIG. 1A represents a carrier plate known in the prior art and FIG. 1B illustrates a carrier plate in accordance with the present invention.

DETAILED DESCRIPTION

Figures 1A, 1B:
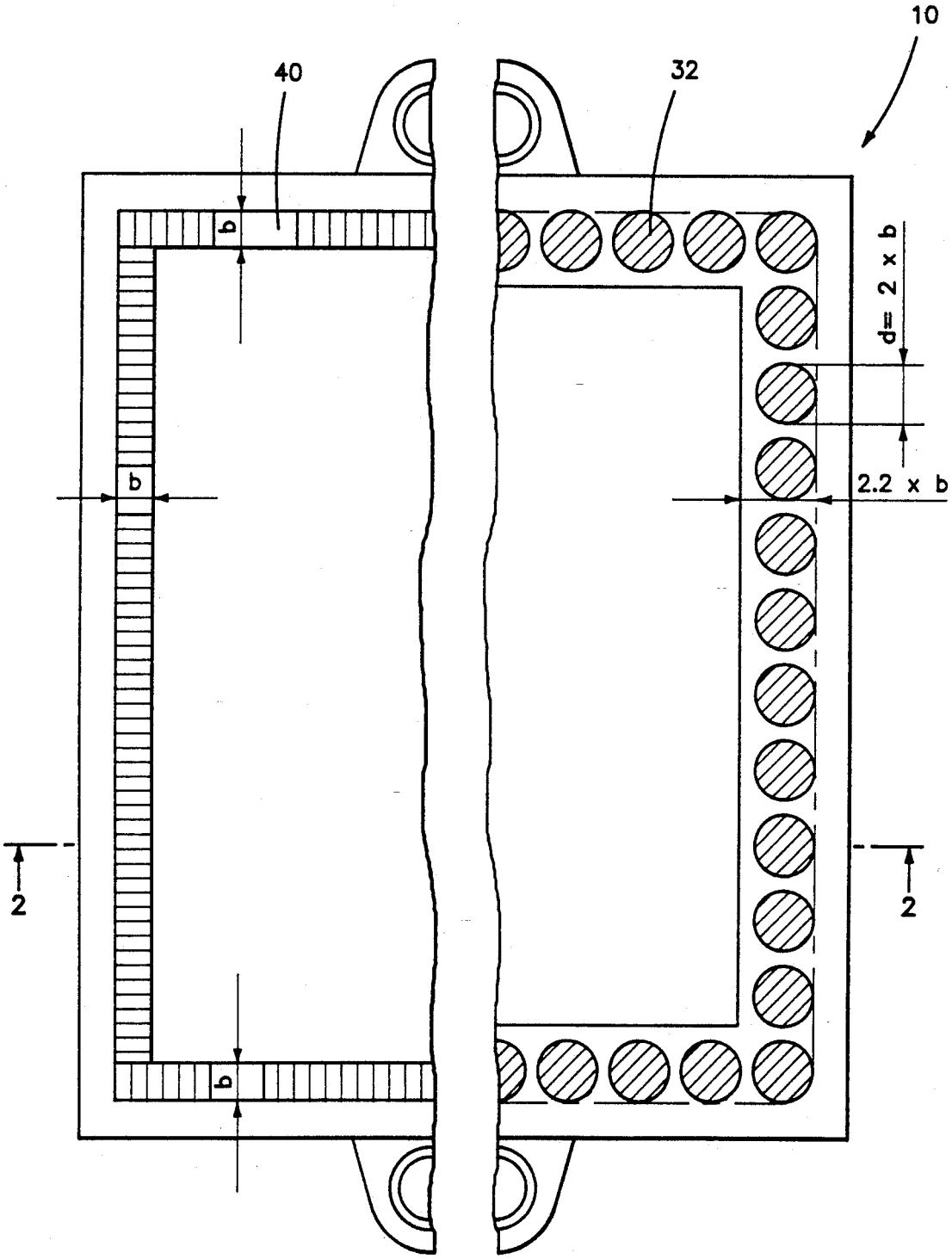
FIG-1A (PRIOR ART)
Figure 2A:
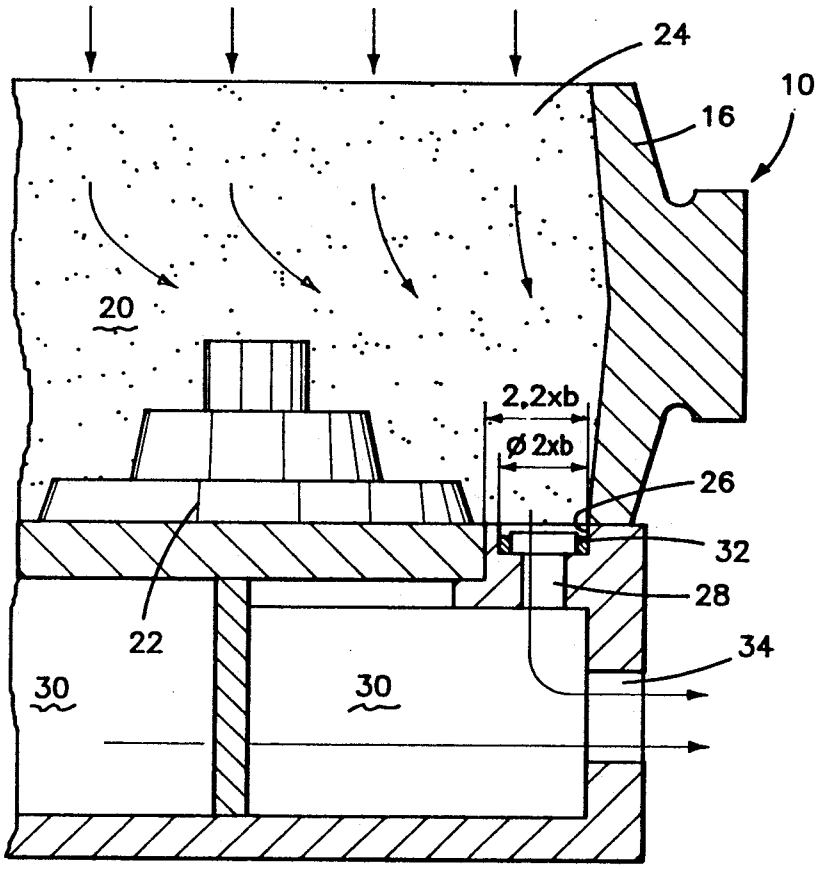
FIG-2A (PRIOR ART)
FIGS. 2A and 2B are cross-sectional views of the carrier plates of FIGS. 1A and 1B respectively in combination with a molding box for defining a sand mold cavity.
Figure 2B:
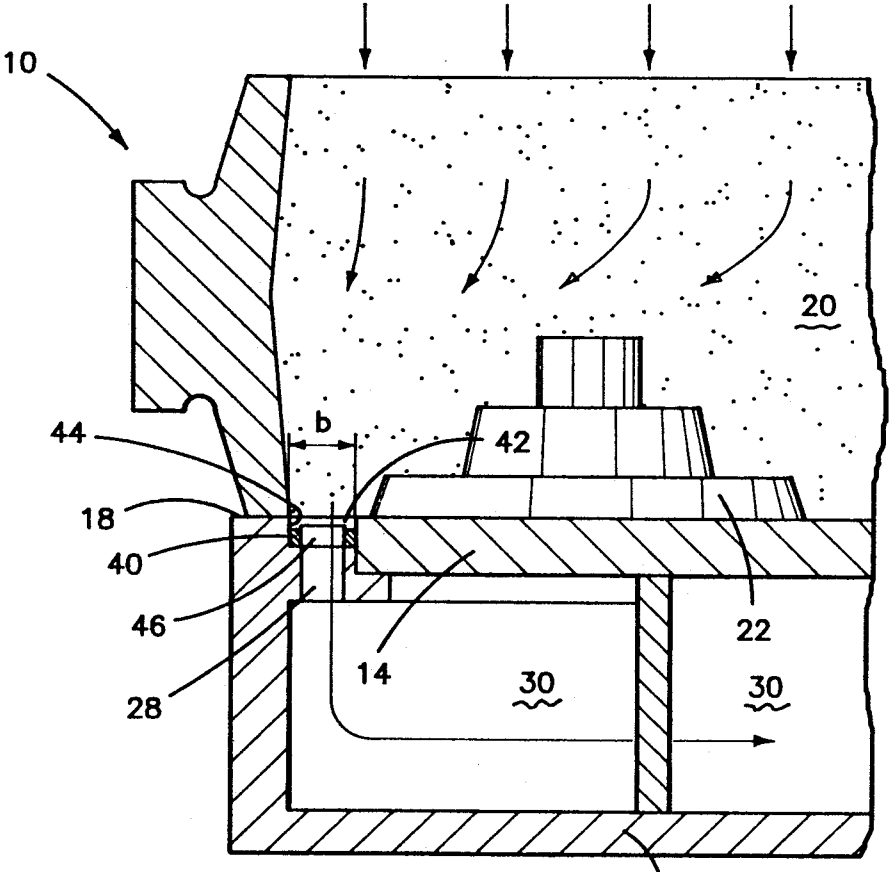

For purposes of illustration only FIG. 1 shows schematically a pattern plate carrier divided in half by line 1—1 wherein the pattern plate carrier structure with nozzles is illustrated on the right hand side of line 1—1 and the pattern plate carrier structure of the preferred embodiment of present invention having slotted bars is illustrated on the left side of line 1—1. FIG. 2 is a cross section of FIG. 1 taken along line 2—2 showing on the right side of section line 1—1 the nozzle venting design for a pattern plate carrier and on the left side of section line 1—1 the preferred slotted bar venting structure of the pattern plate carrier in accordance with the present invention.

With reference to the figures, a partial section of sand molding apparatus 10 is illustrated and comprises a pattern plate carrier 12 for supporting a pattern plate 14 thereon. A mold box 16 is supported on the top surface 18 of the pattern plate carrier and defines therewith a molding space 20. A pattern 22 is located on the pattern plate 14 within the molding space 20. Molding sand 24 is fed to the molding space 20 in any known manner and thereafter the sand on the top surface is subjected to a burst of compressed air for compacting the sand 24 within the molding space 20 about the patterns 22 on the pattern plate 14.

With reference to the right hand sides of FIGS. 1 and 2 the venting structure of the present invention employing slotted nozzles will be described. In order for the air flowing through the molding sand 24 to escape from the molding space 20 the surface 18 of the pattern plate carrier 12 is provided with a plurality of round orifices 26 which communicate with through bores 28 and space 30 defined within the carrier body. Round slotted nozzles 32 are positioned within each of the plurality of round orifices 26 for allowing the air flowing through the molding sand 24 to pass through bore 28, space 30 to atmosphere via openings 34. Each of the round slotted nozzles 32 are provided with slots which are about less than or equal to 0.30 mm wide. The width (w) of the slots increased from top to bottom, that is, as the air passed from the molding space 20 through the slotted nozzles into through bores 28. The slots are so sized so as to allow air to escape through the slots while at the same time prohibiting sand grains from passing therethrough. The free space of the slots which allow for air to pass therethrough, as a result of design considerations, amounted to between 15-20% of the overall surface area of the slotted nozzles 32. Thus, it is necessary, in order to obtain sufficient flow area for the air, to arrange as many slotted nozzles as possible around the periphery of the pattern plate. The diameter of the nozzles and a certain minimum material thickness of the carrier plate surface for supporting the nozzles determine the overall space requirements for the venting structure on the carrier and consequently the size of the pattern plate which can be used for a given mold box size.

In accordance with the preferred embodiment of the present invention, as can be seen from the structure illustrated on the left hand side of FIGS. 1 and 2, it has been found that if the round slotted nozzles 32 are replaced by elongated slotted bars 40 having slots of width (w) not greater than 0.40 mm, preferably 0.30 mm, the space requirement for the venting structure for passing an equal amount of air as the nozzle structure is greatly reduced. In addition, the pattern plate carrier 12 need only be provided with an L-shaped groove 42 on the surface 18 of the carrier for receiving the longitudinal bars 40 and the pattern plate may sit in a recess 44 formed in the carrier 12 with the peripheral edge of the pattern plate 14 abutting the sidewall of the recess 44 and the sidewall of elongated bar 40. As can be seen from the figures, a bar having a width b and slot widths of 0.30 mm can allow for a surface area cross section for the passage of air which is equal to a plurality of round nozzles which would occupy a width on the carrier of about 2.2 b. As can clearly be seen from FIG. 1, the consequences of this is that the pattern plate employed in the molding box having a vent structure in accordance with the preferred embodiment of the present invention may have an area which is up to 25% greater than that which can be achieved in the structure by employing round nozzles. By being able to enlarge the size of the pattern plate, the yield of the molding box can be increased considerably.

In accordance with the preferred embodiment of the present invention the elongated slotted bar employed in the apparatus of the present invention is preferably formed of a U-shaped profile. The U-shaped profile defines with the bottom surface of the L-shaped groove 42 a collecting channel 46 for the air passing through the slots of the U-profile slotted bar. A plurality of vent bores 28 can then be located about the groove 42 for receiving the air from the channel 46. Only a few bores 28 are required to vent the air from the channel to the space 30. To the contrary, when employing the round nozzles, each of the round nozzles requires a precisely located bore 28 for communicating the round nozzle with the space 30. As a result, the slotted bars of the present invention are simpler to manufacture and more economical for the pattern plate carrier of the present invention.

In accordance with the present invention the width of the slots W are less than or equal to 0.40 mm and preferably less than or equal to 0.30 mm. In addition, it is preferred that the slots increase in width from the top of the bar toward the bottom of the bar.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. An apparatus for compacting molding sand with compressed air having a pattern plate and a molding box on the pattern plate which together define a molding space wherein vent means are provided on the pattern plate for allowing the compressed air to escape the molding space on the pattern side of the molding box, the improvement comprises vent means provided on the pattern plate and extending around the pattern plate, said vent means comprising a plurality of elongated slotted bars each having a longitudinal axis and a plurality of slots extending substantially transversely to the longitudinal axis of the bars.

2. An apparatus according to claim 1, wherein the slots are $\leqq$0.4 mm wide and widened toward their bottom.

3. An apparatus according to claim 1, wherein the slotted bars have a U-profile shape.

4. Molding device for use in air-pressurized compaction processes comprises: a pattern plate carrier having a surface for supporting a pattern plate; a pattern plate mounted on a portion of said surface of said pattern plate carrier; a molding box surrounding said pattern plate and spaced therefrom so as to define between the molding box and the pattern plate a peripheral area on the surface of the carrier; and vent means provided on said peripheral area and extending around the pattern plate said vent means comprising a plurality of elongated slotted bars each having a longitudinal axis and a plurality of slots extending substantially transversely to the longitudinal axis of the bars.

5. A device according to claim 4, wherein the peripheral area includes groove means on the surface of the carrier plate extending around the pattern plate and the elongated slotted bars are located within the groove means.

6. A device according to claim 5, wherein a venting channel is provided between the elongated slotted bars and a bottom surface of the groove means.

7. A device according to claim 6, wherein a plurality of venting bores communicate the venting channel with an open space defined by the carrier.

8. A device according to claim 4, wherein the surface of the carrier for supporting the pattern plate is provided with a recess for receiving the pattern plate.

9. A device according to claim 4, wherein the plurality of slots have a width of less than or equal to 0.40 mm.

10. A device according to claim 9, wherein the width of the slots increases with the slot depth.

11. A device according to claim 4, wherein the plurality of slots have a width of less than or equal to 0.30 mm.

12. A sand mold apparatus for use in making sand molds comprises: a carrier having a top surface provided with a recess, a pattern plate mounted within the recess, a molding frame positioned on the carrier and surrounding the pattern plate thereby defining between the pattern plate an interior surface of the molding frame a peripheral area on the top surface of the carrier, groove means provided in the peripheral area and extending around the pattern plate, vent means located in the groove means wherein the vent means comprises a plurality of elongated slotted bars each having a longitudinal axis and a plurality of slots extending substantially transversely to the longitudinal axis of the bars.

13. An apparatus according to claim 12, wherein the peripheral area includes groove means on the surface of the carrier plate extending around the pattern plate and the elongated slotted bars are located within the groove means.

14. An apparatus according to claim 13, wherein a venting channel is provided between the elongated slotted bars and a bottom surface of the groove means.

15. An apparatus according to claim 14, wherein a plurality of venting bores communicate the venting channel with an open space defined by the carrier.

16. An apparatus according to claim 12, wherein the surface of the carrier for supporting the pattern plate is provided with a recess for receiving the pattern plate.

17. An apparatus according to claim 12, wherein the plurality of slots have a width of less than or equal to 0.40 mm.

18. An apparatus according to claim 17, wherein the width of the slots increases with the slot depth.

19. An apparatus according to claim 17, wherein the plurality of slots have a width of less than or equal to 0.30 mm.

* * * * *